United States Patent [19]

Cahill

[11] Patent Number: 4,817,490

[45] Date of Patent: Apr. 4, 1989

[54] PERCUSSION INSTRUMENT

[76] Inventor: Brian F. Cahill, 1244 Ruger Ave., Janesville, Wis. 53545

[21] Appl. No.: 123,400

[22] Filed: Nov. 20, 1987

[51] Int. Cl.[4] ..... G10D 13/02

[52] U.S. Cl. ..... 84/422.1

[58] Field of Search ..... 84/422 R, 422 C, 422 H

[56] References Cited

U.S. PATENT DOCUMENTS 3,618,441 11/1971 Fearns ..... 84/422 R 4,262,576 4/1981 Gorsky et al. ..... 84/422 R

*Primary Examiner*—Lawrence R. Franklin

*Attorney, Agent, or Firm*—Howard M. Herriot

[57] ABSTRACT

A pedal operated cam mechanism for use in a "hi-hat" cymbal instrument. A complete down and up cycle of the pedal causes the cam to oscillate so that a follower rod is attached to one of the cymbals and bearing on the cam is reciprocated a multiple number of times, thereby producing a multiple beat of the cymbals each cycle.

4 Claims, 2 Drawing Sheets

PERCUSSION INSTRUMENT

BACKGROUND OF THE INVENTION

This invention relates to a pedal operated percussion instrument frequently used in dance bands and commonly known in the trade as a "hi-hat." Prior "hi-hat" instruments incorporate a vertical shaft through which a rod is coaxially mounted. A cymbal is mounted on both the rod and shaft in opposed relationship and a spring is attached to the rod to urge it upwardly, when the pedal is not being depressed, to keep the cymbals spaced apart. Downward movement of the pedal brings the cymbals together in percussive engagement and upward movement of the pedal under the spring force returns the cymbals to disengaged position. Thus, in prior "hi-hats", one cycle of the pedal movement produces one beat.

The drummer in a band often likes to beat on the upper cymbal with a drum stick or brush to produce a lighter beat. In order to produce the desired sound, this is done with the cymbals in closed position which requires the drummer using prior art "hi-hats" to either maintain the foot pedal in a depressed position, or to loosen a wing nut on the top cymbal and drop it into contact with the lower cymbal. The former alternative continuously occupies the drummer's foot while the latter alternative requires him to stop and re-position the upper cymbal in its higher position when he desires to again operate the "hi-hat" with the foot pedal.

Some bands, particularly "rock" bands, include two bass drums. These drums, plus the "hi-hat" mean there are three foot pedals to operate. If one foot is required to maintain the "hi-hat" pedal depressed while the cymbals are played with a drum stick, one bass drum cannot be played. If the top cymbal has been lowered by dropping it on its rod, sooner or later the drummer must occupy either one or both hands and a foot (depending on the drummer and his style) to reposition it in order to play the "hi-hat" with the foot pedal again.

These arrangements are awkward and undesirable because they disrupt the rhythm by requiring the drummer to occupy his hands or a foot when they could otherwise be engaged more productively.

SUMMARY OF THE INVENTION

This invention obviates the above problems and additionally permits the "hi-hat" player to produce a multiple beat with each complete cycle of the foot pedal. At ready position, (foot pedal in its uppermost position) the cymbals are closed together so they may be played with a drum stick or brush without any special preparation or assistance from the musician's foot.

A cam is rotatably mounted in the lower part of the frame such that its outer peripheral surface contacts a rod on which the upper cymbal is mounted. A foot pedal is linked to the cam so that depression of the foot pedal causes the cam to rotate and reciprocate the rod, thereby bringing the cymbals into and out of contact a predetermined number of times depending on the cam profile and degree of its rotation.

The unique design allows at least one percussive beat to be produced with one downward movement of the foot pedal and at least another beat upon return of the foot pedal to its starting, or ready, position. Thus, the musician can produce a beat faster and more beats per complete cycle of pedal movement as compared to the standard "hi-hat" set.

It is, therefore, an object of the invention to provide mechanism for use in a "hi-hat" musical instrument which produces a multiple beat with each complete cycle of pedal movement.

Another object is to provide a "hi-hat" musical instrument having its cymbals closed when in the ready position.

Still another object is to provide a "hi-hat" on which at least one percussive beat can be produced with one downward pedal movement.

Still another object is to provide a "hi-hat" which neither requires the cymbals to be adjusted while being played, nor the foot pedal to be depressed solely to hold the cymbals together to allow them to be played with a brush or drum stick.

A feature of the invention is the provision of a cam to actuate the upper cymbal.

These and other objects, features, uses and advantages of the invention will become apparent to those skilled in the art as the following description of the preferred embodiment is read in conjunction with the accompanying drawings.

DESCRIPTION OF THE PREFERRED EMBODIMENT

Structure

Figure 1:
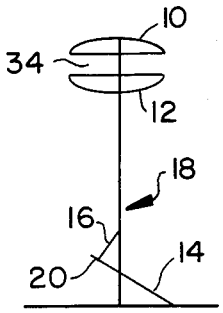
FIG. 1 PRIOR ART
FIG. 1 is a schematic elevational view of a prior art "hi-hat" showing the cymbals spaced apart when the foot pedal is in its upper position.
Figure 2:
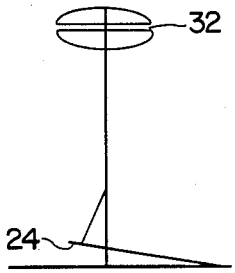
FIG. 2 PRIOR ART
FIG. 2 is the "hi-hat" shown in FIG. 1 with the foot pedal depressed.

As shown in FIGS. 1 and 2, cymbals 10, 12 in prior art "hi-hat" 18 are spaced apart at 34 by linkage rod 16 when foot pedal 14 is in its uppermost position 20. They are in closed, or engaged, position 32 when the foot pedal is in its lowermost position 24 and, therefore, only one percussion beat is produced each complete cycle of the pedal movement between positions 20, 24, 20.

Figure 3:
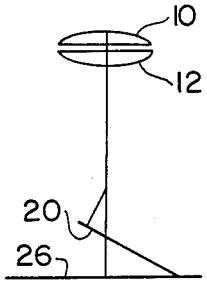
FIG. 3 is a schematic elevational view of the "hi-hat" of this invention showing the foot pedal in its upper position.
Figure 4:
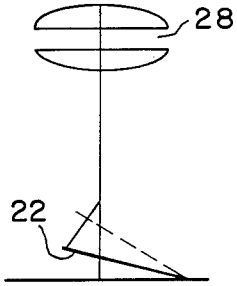
FIGS. 4 and 5 are the "hi-hat" shown in FIG. 3 with the foot pedal depressed half-way and completely, respectively.
Figure 5:
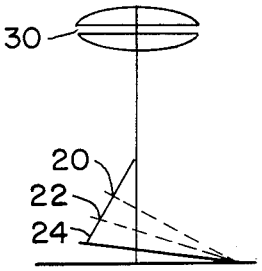
Figure 6:
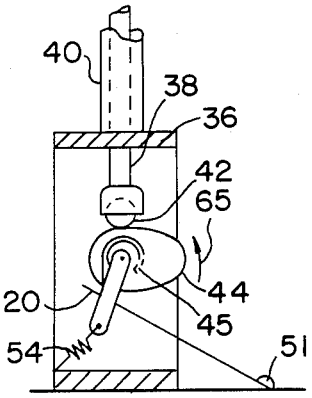
FIGS. 6, 7, and 8 are views through section I—I of FIG. 9 and shown the cam position for the cymbal positions shown in FIGS. 3, 4, and 5, respectively.

In the invention shown in FIGS. 3, 4, and 5, the cymbals are closed when the foot pedal is in its uppermost position 20, are gapped as indicated at 28 when the foot pedal is depressed to its intermediate position 22, and closed together again as shown at 30 in FIG. 5 to produce a percussive beat when the foot pedal is depressed to its lowermost position 24. Thus, one beat is produced for each half cycle 20, 24, of pedal movement, and two beats are produced each complete cycle 20, 24, 20 of pedal travel.

In FIGS. 6 through 10, cam 44 is mounted to a horizontally disposed axial shaft 46 which in turn is rotatably, or pivotably, mounted in the parallel upright side walls 35, 36 of the frame, referred to generally by item 26, with bearings (not shown) or other suitable means. A flexible strap 50 is pinned at one end 45 to shaft 46 and partially wrapped there-around. Its other end 43 is attached to foot pedal 14 which is pivotally mounted to frame 26 at 51. Upright side walls 35, 36 are mounted to upper and lower base portions 39, 37, respectively, or frame 26. A spring 54 is attached to lower base portion 37 and lever arm 8 on shaft 46 resiliently urges pedal 14 to its upper position 20 when it is not being depressed by the musician. It also resiliently urges the cam back to its starting position shown in FIG. 6 after the cam has been rotated to another position.

An upright shaft portion 40 is telescoped into a lower upright shaft portion 41 which is mounted to the top of upper base portion 39. A set screw 81 through portion 41 permits vertical adjustment. A rod member 38 is slidably mounted coaxially through shaft 40, 41 and extends through upper base portion 39 directly above cam 44. A cam follower wheel housing 52 is attached to the lower end of rod 38 and follower wheel 42 rotatably mounted therein rides on the outer peripheral surface 59 of cam 44.

Figure 9:
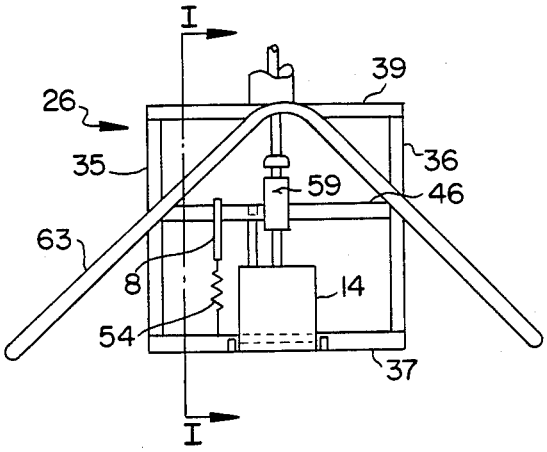
FIG. 9 is a front elevational view of the cam and foot pedal mechanism of the invention in the lower portion of the frame.
Figure 10:
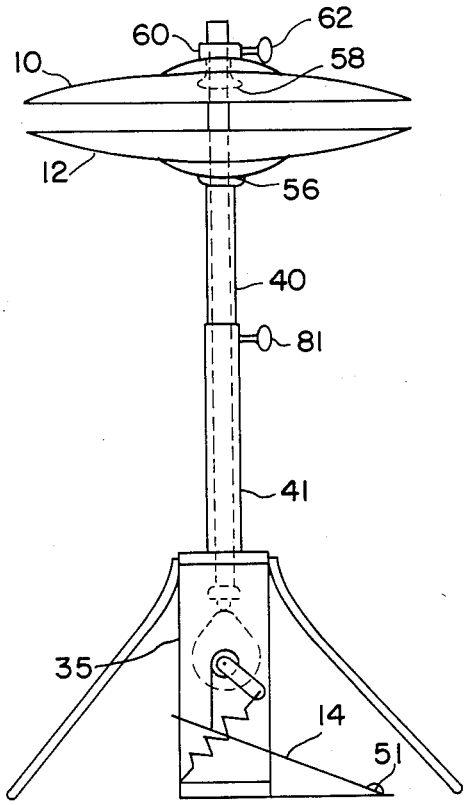
FIG. 10 is a side elevational view of the mechanism shown in FIG. 9 and also including the cymbal arrangement mounted on top of the frame shaft and rod.
Figure 10A:
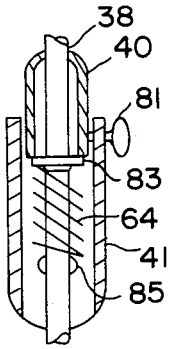
FIG. 10A is an enlarged cutaway view, partially in section, of the shaft in FIG. 10 showing the spring which hold the rod against the cam.

As shown in FIGS. 9 and 10 an upper cymbal 10 is center mounted to the upper end of rod member 38 by an annular sleeve 57 having a lower support ring 58. The upper portion has a collar 60 which is attached to the rod member by a wing screw 62. The lower cymbal 12 is center mounted on support hub 56 on shaft portion 40 of frame 26 and faces cymbal 10. On the lower end of rod member 38, a spring 64 is mounted between a pinched flange 85 on rod 38 and washer 83 bearing against the bottom of upper shaft 40 to urge cymbals 10, 12 together when not being moved apart by cam 44. Stability of the entire instrument is provided by tripod stand legs 63 mounted to the upper base portion 39 of frame 26.

OPERATION

Figure 11:
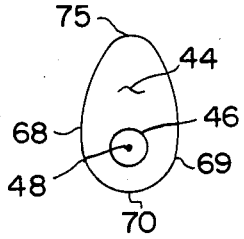
FIGS. 11 and 12 illustrate two plate, or disk, cam profiles.

From the uppermost, or ready, position 20, depression of foot pedal 14 causes strap 50 to rotate shaft 46 about its horizontal axis 48 which in turn rotates cam 44 in the direction of arrow 65. Cam 44, as shown more clearly in FIG. 11, is a lobe cam wherein side peripheral surface portions 68, 69, 70 are approximately equidistant from axis of rotation 48 of shaft 46. A peripheral lobe surface portion 75 extends radially from axis 48 a distance greater than the other side surface portions.

Figure 7:
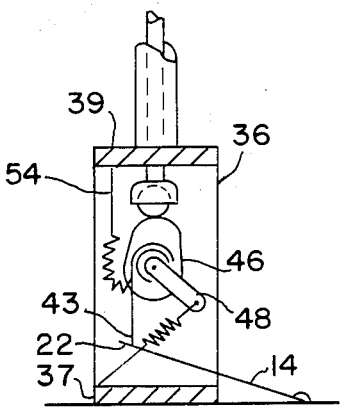
Figure 8:
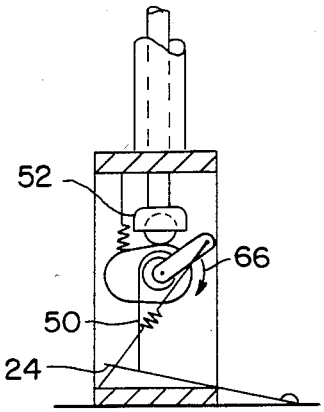

As cam 44 rotates, follower wheel 42, travelling from surface portion 68 to surface portion 75 is pushed upward until it reaches the position shown in FIG. 7 where cymbals 10, 12 are gapped. Foot pedal 14 is then in the intermediate position 22. Continued downward movement of foot pedal 14 to its lowermost position 24 causes cam 44 to rotate to the position shown in FIG. 8 wherein follower wheel 42 is on the other side surface 69 and the cymbals have returned to their contacting position 30 shown in FIG. 5. When the musician releases his foot, spring 54 causes the cam to rotate in the opposite direction shown by arrow 66 so that the foot pedal (and cam) is returned to starting position 20. Thus, a double percussion beat is produced with each complete down and up pedal movement through positions 20, 22, 24, 22, 20. Spring 64 maintains follower wheel 42 constantly in contact with the outer peripheral cam surface 59.

Contemplated modifications can be made in the structure. For example, spring 54 and strap 50, which resiliently cooperate to provide the means linking foot pedal 14 with the cam, can be combined into one item to function as both a spring and strap, such as making strap 50 from wound up coil spring or a flat spring. The spring would then wind and unwind around rotatable shaft 46 as the cam pivots back and forth. Spring 54 can be mounted anywhere it will operate to urge cam 44 back to its starting position with foot pedal up. Thus, spring 54 could be a compression spring mounted to the underside of the foot pedal and the strap could be stiff enough to translate the spring force to the cam shaft to rotate it as the pedal moves upwardly. The foot pedal can also be counterweighted to the spring would not be required.

Figure 12:
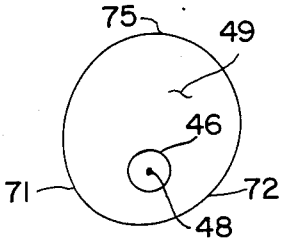

Cam 44 can be provided with more than one lobe surface portion 75 if more than a double heat is desired during a complete pedal cycle. The cam profile can be any suitable shape such as an eccentric circular disk 49 shown in FIG. 12 wherein outer peripheral surfaces portions 71, 72 are radially closer to axis 48 than outer peripheral surface portion 75.

If the weight of cymbal 10 and the cam profile are such that wheel 42 easily maintains contact during operation, or if the cam and follower are the positive motion type, spring 64 can be eliminated.

The force of the strap acting on shaft 46 causes it to cooperate with cam 44 to function as a lever to raise rod member 38. It is contemplated that other lever-like mechanisms, or cams, such as cylindrical, translating or other profile shapes of eccentric cams, can be used to raise rod member 38.

While the preferred embodiment has been described in detail, these and other modifications apparent to those skilled in the art can be made without departing from the spirit and scope of the invention.

I claim:

1. A foot pedal operated hi-hat cymbals musical instrument for producing a double beat with each complete cycle of pedal movement, comprising:

a frame having a support stand and an upright tube;

a rod slidably extending through said tube;

a pair of cymbals, the upper one mounted on said rod, and the lower one mounted on said tube;

a cam axle pivotably mounted on and extending horizontally across said stand below said tube and rod;

a lobe cam fixed to said cam axle with its cam surface engaging the lower end of said rod, the lobe part of said cam surface when engaging said rod raising said upper cymbal apart from said lower cymbal, and the regular part of said cam surface on each side of said lobe part when engaging said rod dropping said upper cymbal against said lower cymbal;

a foot pedal pivotably mounted on said stand with its free end above its pivoted end and disposed below said cam and cam axle;

a flexible strap having one end connected to and partially wrapped around said cam axle, and having its other end connected to said free end of said pedal;

a lever arm mounted on and extending out from said cam axle;

a spring attached to said stand and to the extended end of said lever arm, resiliently urging said free end of said pedal to an undepressed upper position wherein said regular part of said cam surface on one side of said lobe part places the cymbals in closed position, whereby when said free end of said pedal is partially depressed said lobe part of said cam surface places the cymbals in open position, and when said free end of said pedal is fully depressed said regular part of said cam surface on the other side of said lobe part places the cymbals in closed position.

2. A foot pedal operated hi-hat cymbals musical instrument for producing a double beat with each complete cycle of pedal movement, comprising:

a frame having a support stand and an upright tube;

a rod slidably extending through said tube;

a pair of cymbals, the upper one mounted on said rod, and the lower one mounted on said tube;

a cam axle pivotably mounted on and extending horizontally across said stand below said tube and rod;

a lobe cam fixed to said cam axle centrally thereof with its cam surface engaging the lower end of said rod;

a foot pedal pivotably mounted on said stand with its free end above its pivoted end and disposed below said cam and cam axle; and a linkage means connecting said free end of said pedal to said stand through said cam axle resiliently urging said cam to its starting position and said pedal to its undepressed starting position for controlling said cam and rod to raise and drop said upper cymbal whereby said cymbals are closed together when said pedal is undepressed, are spaced apart when said pedal is partially depressed, and are again closed together when said pedal is fully depressed.

3. The instrument set forth in claim 2 wherein said linkage means includes:

strap means connected to and wrapped on said cam axle; and resilient means connecting said cam axle and said frame.

4. The instrument set forth in claim 3 wherein said resilient means includes a lever extending out from said cam axle and a spring connecting said lever to said frame.

* * * * *